US006035469A

United States Patent [19]

Schrougham

[11] Patent Number: 6,035,469

[45] Date of Patent: Mar. 14, 2000

[54] BED SKIRT

[76] Inventor: Judith A. Schrougham, 734 N. 11th St., Allentown, Pa. 18102

[21] Appl. No.: 09/250,499

[22] Filed: Feb. 16, 1999

[51] Int. Cl.[7] ..... A47G 9/04; A47C 21/02

[52] U.S. Cl. ..... 5/493; 5/923

[58] Field of Search ..... 5/493, 482, 922, 5/923, 496, 498, 499

[56] References Cited

U.S. PATENT DOCUMENTS

| | | | |
|---|---|---|---|
| 1,421,028 | 6/1922 | Rimmington | 5/493 |
| 1,742,693 | 1/1930 | Coghlan | 5/493 |
| 2,619,658 | 12/1952 | Weinberg | 5/493 |
| 2,763,875 | 9/1956 | Piontkowski | 5/493 |
| 3,999,233 | 12/1976 | Morris | 5/493 |
| 4,141,097 | 2/1979 | Levinsohn et al. | 5/493 |
| 4,587,683 | 5/1986 | Gardiner | 5/493 |
| 4,796,317 | 1/1989 | Kallman et al. | 5/493 |
| 4,807,316 | 2/1989 | Whipple | 5/493 |
| 5,205,003 | 4/1993 | Green | 5/493 |
| 5,271,112 | 12/1993 | Bible et al. | 5/493 |
| 5,335,383 | 8/1994 | Schwind | 5/493 |
| 5,404,601 | 4/1995 | O'Neill et al. | 5/493 |
| 5,621,931 | 4/1997 | Hamilton | 5/493 |
| 5,638,562 | 6/1997 | Masoncup | 5/493 |
| 5,715,553 | 2/1998 | Baron et al. | 5/493 |

*Primary Examiner*—Alexander Grosz
*Attorney, Agent, or Firm*—Charles A. Wilkinson

[57] ABSTRACT

A bed skirt having a downwardly extending ruffle and panel sections that are tucked between an upper and lower mattress to maintain such bed skirt in a proper position and alignment with respect to the lower mattress. The panels sections are equipped with adjustable fastening implements that are used to secure the positioning of the panel sections with respect to each other. The panel sections are designed to be incrementally inserted between an upper and lower mattress, and the fastening implements allow a user to secure the panel sections in proper alignment with respect to each other and with respect to the lower mattress once inserted and positioned thereupon.

10 Claims, 3 Drawing Sheets

Fig. 2
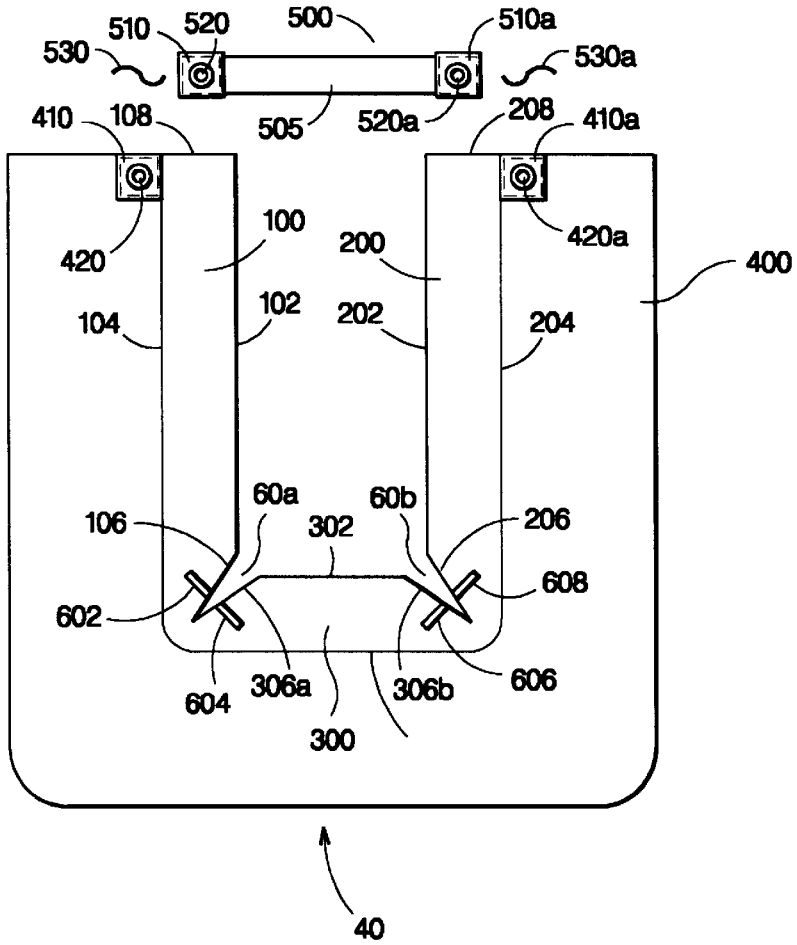
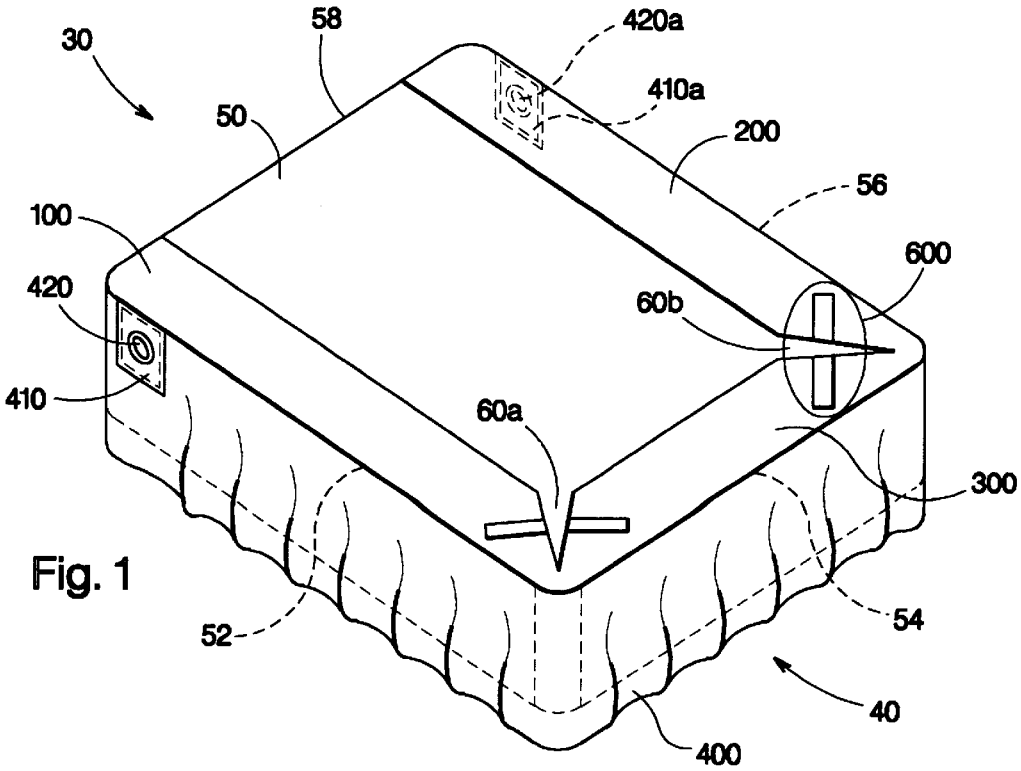
Fig. 1

Fig. 3
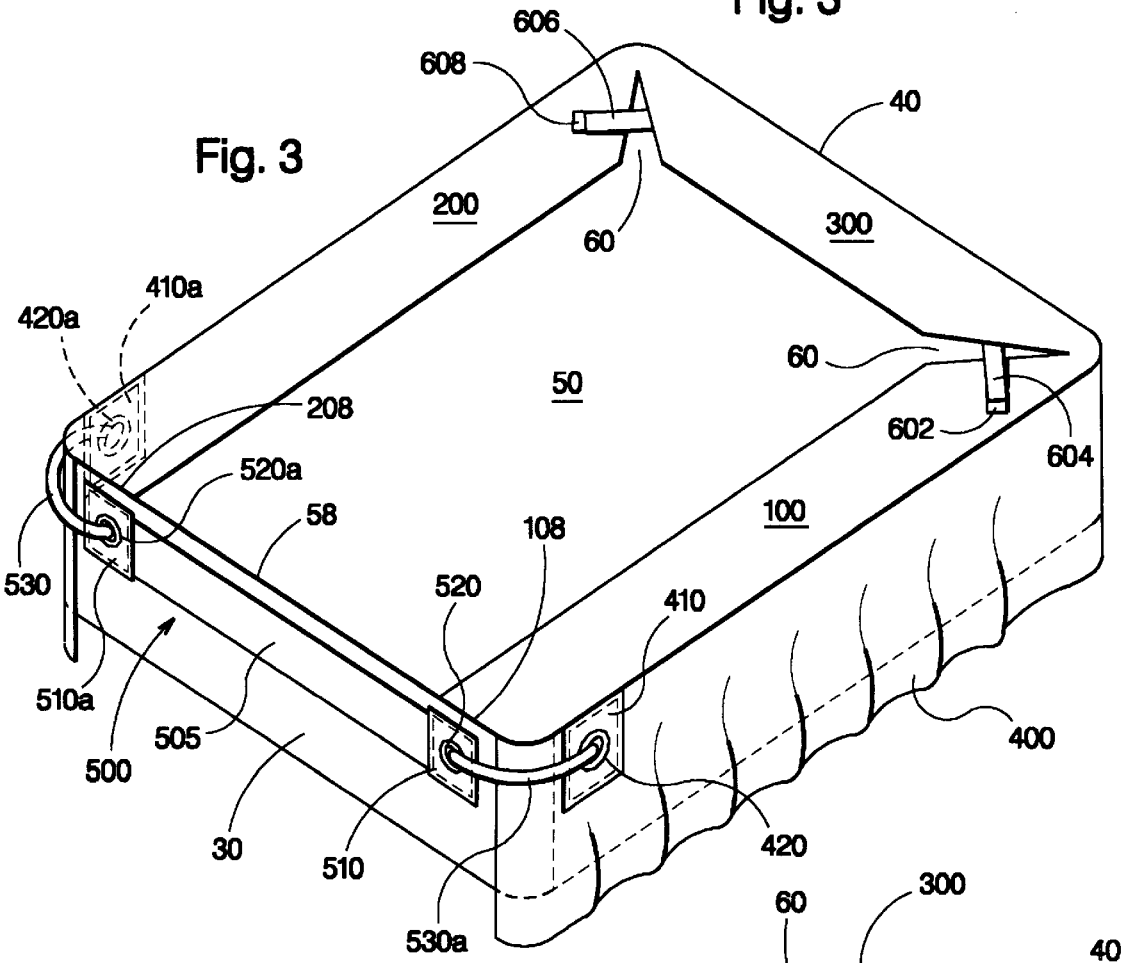
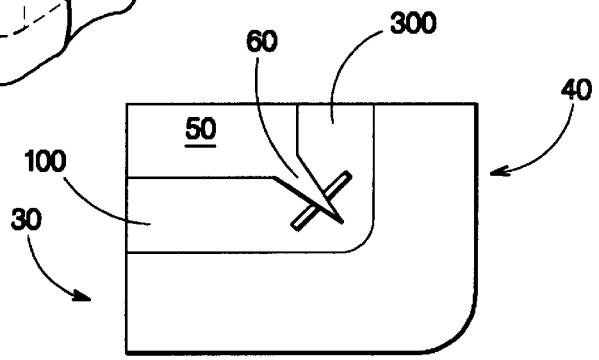
Fig. 6
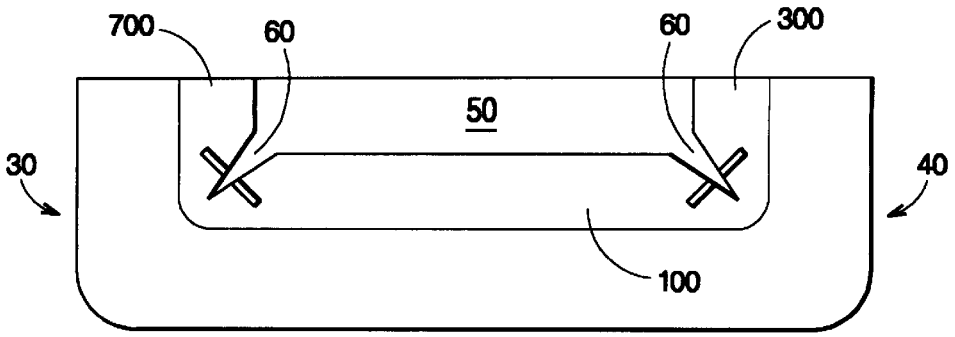
Fig. 7

BED SKIRT

BACKGROUND OF THE INVENTION

1. Field of the Invention

This invention relates to bed skirts and dust ruffles generally, and more particularly to a single-piece bed skirt having fastenable corners, that can be easily inserted between an upper mattress and a lower mattress without having to completely or partially remove the upper mattress, and once inserted, will stay in place.

2. Preliminary Discussion

Bed skirts and dust ruffles are both practical and aesthetically enhancing. Bed skirts assist in preventing dust and other foreign objects from invading and settling beneath a bed. They also hide items that may be stored or otherwise placed beneath a bed, and are usually decorated to match the owner's comforter or blanket to create the appearance of an extension of such comforter or blanket.

The conventional bed skirt comprises a flat, basically rectangular sheet of cloth positionable between an upper and a lower mattress having a border of material extending downwardly along the sides and foot of such lower mattress from the edges of such sheet of cloth, which supports the downwardly extending material or skirts. The skirt, or downwardly extending material, is usually ruffled and decorated to match the original bed clothes. The supporting sheet is usually dimensioned to fit over a conventional lower mattress or box spring, such that the edges of the supporting sheet are flush with the mattress enabling the skirt section to merely hang downwardly from the sides of such supporting sheet.

The supporting sheet section of a conventional bed skirt must be placed directly onto the upper surface of a lower mattress in order to properly position the skirt portion along the perimeter or partial perimeter of a bed. Placement of the supporting sheet onto the lower mattress and subsequent adjustment of such supporting sheet usually requires the complete removal of the upper mattress, a task easily accomplished by only the very able-bodied. Manipulation of a mattress for placement or removal of a bed skirt can be challenging even for the very able-bodied, particularly if the mattress is queen-or king-sized. The requirement for removing, or removal of, the top mattress can make cleaning a bed skirt a chore, and may even completely deter its use altogether.

Ideally, a bed skirt should be easy to insert between an upper and lower mattress, easy to adjust once inserted and easy to remove for replacing, cleaning or the like. There is a need, therefore, to provide a bed skirt capable of easy insertion, adjustment and removal. The prior art has attempted to address this particular problem, but for numerous reasons, not all of which are clear, such prior art has not met with significant commercial success.

3. Description of Related Art

The evolution within the prior art of bed skirts has been somewhat unremarkable. One of the earliest references to address this type of product is U.S. Pat. No. 1,421,028 issued to W. J. Rimmington on Jun. 27, 1922, entitled "Mattress," which discloses a valance sewn into the middle of a mattress. The Rimmington valance is quite invasive, and requires the permanent attachment of such valance onto the mattress. As with conventional designs employing a top supporting sheet with an extending perimeter skirt, it would be preferable if the valance or bed skirt were completely separate and disconnected from the mattresses.

U.S. Pat. No. 2,763,875 issued to G. A. Piontkowski on Sep. 25, 1956, entitled "Decorative Valances," discloses removably attachable valance sections joined, or attached, to a box spring by a piece of tape having snap fasteners positioned upon a special box spring cover. The Piontkowski valance requires the removal of the upper mattress for the initial placement of the special box spring cover.

U.S. Pat. No. 3,999,233 issued to M. Morris on Dec. 28, 1976, entitled "Dust Ruffle," discloses a center-less dust ruffle extendable, in one embodiment, about the entire perimeter of a lower mattress. The Morris dust ruffle includes fixed, mitred corners, which require the user to initially position the ruffle in its entirety around the bed, without enabling the user to insert and/or remove the ruffle one side at a time. The fixed, mitred corners also prevent the user from altering the position of one side of the ruffle without similarly affecting the other sides.

U.S. Pat. No. 4,141,097 issued to R. Levinsohn et al. on Feb. 27, 1979, entitled "Dust Ruffle," discloses an elastic perimeter band comprising strips sandwichable between an upper and lower mattress. Similar to the Morris reference, the Levinsohn et al. bed skirt lacks a center sheet, but also lacks the flexibility to maneuver each skirt piece independent of the skirt as a whole.

U.S. Pat. No. 4,587,683 issued to R. Gardiner on May 13, 1986, entitled "Zip-On Zip-Off Dust Ruffle," discloses a dust ruffle attached to a box spring cover member by way of a perimeter zipper fastener. The cover member must be pre-attached to the box spring or lower mattress and does, therefore, not provide for effortless or easy attachment of the dust ruffle to the bed.

U.S. Pat. No. 4,796,317 issued R. Kallman et al. on Jan. 10, 1989, entitled "Dust Ruffles for a Bed," discloses a center-less dust ruffle attachable to a box spring or lower mattress via pre-placed fasteners positioned along the edges of such box spring or lower mattress. The Kallman system requires the protrusion of sharp objects into the box spring or lower mattress to keep the dust ruffles in place. The present inventor feels it would be preferable if the valance or bed skirt were completely separate and disconnected from the mattresses.

U.S. Pat. No. 4,807,316 issued to G. R. Whipple on Feb. 28, 1989, entitled "Dust Ruffle," discloses another center-less dust ruffle comprising integrally connected panel segments. Strip-like seams are used to position and/or reorient placement of the dust ruffle after it has been inserted between the mattress and box spring or lower mattress.

U.S. Pat. No. 5,205,003 issued to J. E. Green on Apr. 27, 1993, entitled "Releasable Dust Ruffle Arrangement," discloses a box spring cover having two rows of Velcro®-like tabs along the side of the cover for releasable attachment of two sets of dust ruffle covers. The box spring cover must be pre-attached to the box spring or lower mattress and does, therefore, not provide for effortless or easy attachment of the dust ruffle to the bed.

U.S. Pat. No. 5,271,112 issued to S. J. Bible on Dec. 21, 1993 entitled "Elastic Bed Ruffle," discloses an elastic, unitary piece of material designed to extend over the upper and lower perimeter of a box spring or lower mattress. The Bible bed ruffle must be stretched over the upper and lower mattresses, and may not be easily inserted between such mattresses one side at a time.

U.S. Pat. No. 5,621,931 issued to S. Hamilton on Apr. 22, 1997, entitled "Mattress Stabilizing Bedskirt Assembly having Detachably Attachable Skirt Components," discloses a non-slip grip deck comprised of a non-slip fabric having releasable or detachable fasteners located around the perimeter of the fabric for the mating or cooperation with dust ruffle panels having similar attachment means. The grip deck must be pre-attached to the box spring or lower mattress and does, therefore, not provide for effortless or easy attachment of the dust ruffle as a whole to the bed.

U.S. Pat. No. 5,638,562 issued to J. F. Masoncup on Jun. 17, 1997, entitled "Bed Cover Structure with an Improved Dust Ruffle," discloses a fitted upper mattress cover having elongated side extensions with attachment means for cooperating with similar attachment means on a dust ruffle piece placed between the upper and lower mattresses.

One of the most recent contributions to the prior art is U.S. Pat. No. 5,715,553 issued to D. Baron et al. on Feb. 10, 1998, entitled "Bed Skirt," which discloses a Velcro®-type strip pre-attached to a box spring for cooperation with dust ruffle sections having mating Velcro® strips adhered thereto. The Baron bed skirt, along with some of the other references discussed above, requires the user to prepare the existing bedding environment prior to insertion or implementation of the actual bed skirt.

This extra step of preparing the lower mattress or box spring with special attachment means, whether it be a strip of Velcro® or an entire sheet fitted with cooperating attachment members, may tend to complicate matters enough to deter the use of such bed skirt. For example, if the box spring had to be fitted with a special sheet prior to placement of the bed skirt, then such sheet would, in addition to the bed skirt, have to be applied and removed if the owner wished to wash such sheet at the same time as the other bed clothes, including the bed skirt.

The prior art also includes some bed skirts that are generally of a one piece construction, but without a center, and tend to simulate a fitted sheet requiring the owner to essentially "fit", as opposed to "insert" the bed skirt about the perimeter of a bed. Most of these one piece bed skirts further comprise elastic material or perimeter seams, which may tend to further complicate the application and removal of the bed skirt, particularly if the bedding is somewhat large and deep.

The present inventor, after years of frustration and aggravation dealing with bed skirts available in the market, perceived a need to design a bed skirt assembly having elements or components addressing the features of easy insertability, adjustment and removal. Such bed skirt should be preferably a one piece construction, should not require the preparation or pretreatment of the upper or lower mattress, and should not require any strain exertion on the part of the user, as is normally required, for example, during application of an elastic-based fitted sheet onto a mattress. Such bed skirt should also be easily inserted and removed from between the upper and lower mattress without removal of the upper mattress at any time during the process.

OBJECTS OF THE INVENTION

It is an object of the present invention, therefore, to provide a bed skirt that is easy to insert and remove from between an upper and lower mattress without having to remove the upper mattress.

It is a further object of the present invention to provide a bed skirt that is easy to adjust once inserted and easy to remove for replacing, cleaning or the like.

It is a still further object of the present invention to provide a bed skirt of, or having, a single piece, perimeter or partial perimeter construction.

It is a still further object of the present invention to provide a bed skirt that is insertable and removable in an incremental fashion about a bed perimeter.

It is a still further object of the present invention to provide a bed skirt that does not require the special preparation or pretreatment of the upper or lower mattress prior to application of the bed skirt.

It is a still further object of the present invention to provide a bed skirt having a plurality of positionable panels insertable along the perimeter of a bed and fixable in position with respect to one another during the incremental insertion of such panels.

It is a still further object of the present invention to provide a bed skirt having slit portions at the corners of contiguous supporting sections, allowing the individual sections to be individually adjusted between superimposed mattresses, or between a box spring and a mattress, plus a securing means for securing the ends of the supporting sections together during use to counteract any tendency of the supporting sections to work or slip from between the mattresses or box spring and mattress.

It is a still further object of the present invention to provide a bed skirt having an additional detachable fastener for further securing of the bed skirt to the lower mattress.

Still other objects and advantages of the invention will become clear upon review of the following detailed description in conjunction with the appended drawings.

SUMMARY OF THE INVENTION

The device of the present invention comprises a bed skirt preferably formed of three panel sections positionable along the edges of the sides and lower end of a box spring or lower mattress, having a ruffle or skirt portion extending downwardly therefrom. Each panel section is joined along the seam or portion from which the ruffle or skirt portion depends, thus forming a single piece construction. There is a gap at the junction of each panel, which allows each panel to be manipulated independently of each other. Means are also provided to secure the position of adjacent panels with the addition of fastening members extendable across such gap.

The bed skirt of the present invention is designed to be incrementally tucked, in sections or panels, between an upper and lower mattress. Such sections or panels are also designed to be incrementally fastened or secured to each other, thereby creating a more secure environment. The bed skirt of the present invention also may include or comprises an additional fastening piece or member positionable along the head portion of the mattress to further secure the bed skirt assembly to the mattress.

BRIEF DESCRIPTION OF THE DRAWINGS

FIG. 1 is a perspective view of a mattress showing the bed skirt of the invention positioned thereon.

FIG. 2 is a top, diagrammatic view of the bed skirt of the invention.

FIG. 3 is a perspective view of a mattress shown from the head portion of the mattress showing the bed skirt of the invention positioned thereon with an additional, detachable fastener positioned between opposite dust ruffle ends.

FIG. 6 is a top view of an alternative embodiment of the bed skirt of the invention showing a bed skirt positioned on a bed that is itself positioned lengthwise against a wall.

FIG. 7 is a top view of an alternative embodiment of the bed skirt of the invention showing a bed skirt positioned on a bed that is itself positioned against a corner.

DESCRIPTION OF THE PREFERRED EMBODIMENTS

Figure 4:
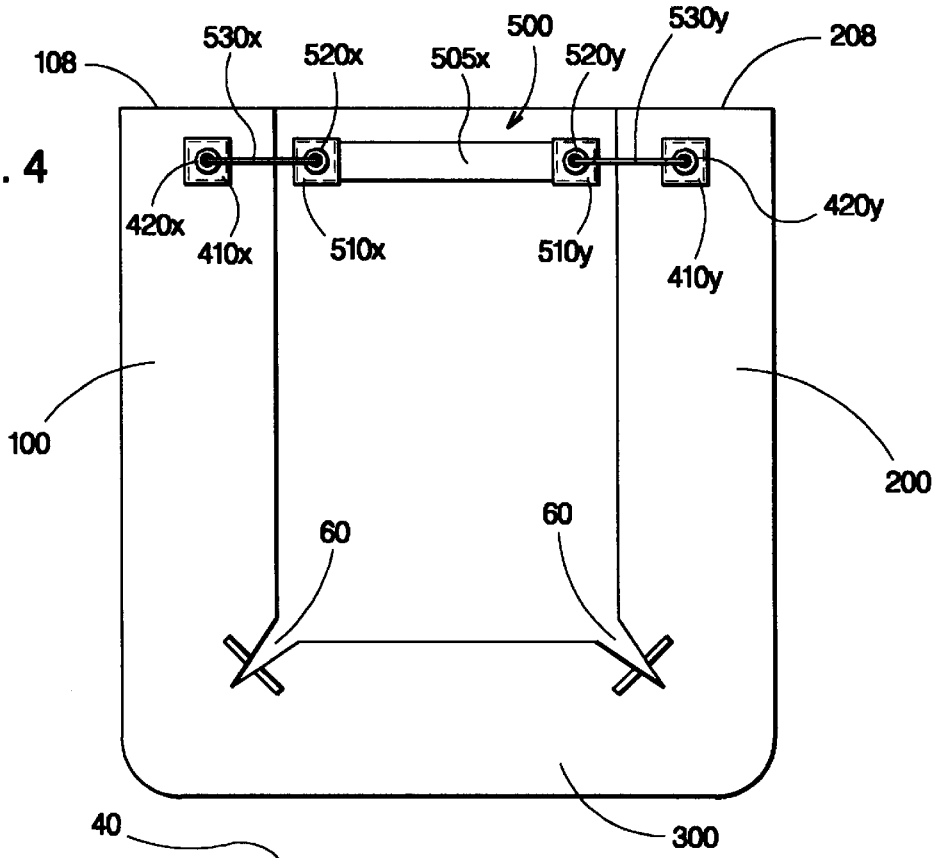
FIG. 4 is a top view of an alternative embodiment of the bed skirt of the invention showing an alternative placement of a detachable fastener extending between oppositely located panels.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

FIG. 1 is a perspective view of a mattress 50, and more particularly and preferably a lower or box spring-type mattress, showing the bed skirt of the invention positioned thereupon. Upper and lower mattresses, whether the lower mattress is a regular mattress or a so-called box spring-type mattress, will hereafter be generally referred to as an upper or lower mattress, or in some cases just a mattress. The bed skirt of the invention comprises three panel sections 100, 200 and 300, hand insertable or tuckable and positionable along the first and second longitudinal edges 52 and 56 of the mattress 50 and the transverse edge 54 located at the foot 40 of the mattress 50 opposite edge 58 located at the head 30 of the mattress 50, having a continuous ruffle or skirt portion 400 extending downwardly from the supporting panel sections. Each panel section is joined along the seam or portion of such panel from which the ruffle or skirt portion 400 depends, thus forming a single piece construction. There is a gap 60 at the junction of each panel with an adjacent panel, which allows each panel to be manipulated independently of the other. Means are also provided to secure the position of adjacent panels with the addition of fastening members, designated generally as 600, extendable across such gaps 60*a* and 60*b*. The ruffle or skirt portion 400 also preferably contains a patch of material 410 and 410*a* on either side of the ruffle or skirt portion 400 having a fastener receiving element 420 and 420*a* to receive a detachable fastener (shown in FIG. 2) for fastening the ruffle portion 400 circumferentially about the mattress 50. It should be understood that as stated the fastening patch 410 is only used in the most preferred or best embodiment of the construction, as it will be found that the dust ruffle arrangement of the invention is also very satisfactory in most cases without any fastening at all at the upper end or head end, as this end has a decreased tendency for the panels 100 and 200 to slip out from between superimposed mattresses or a mattress and a box spring.

FIG. 2 is a top, diagrammatic view of the bed skirt of the invention. The first panel 100 of the bed skirt of the invention comprises an inner portion 102 positionable toward the center of a mattress, an outer portion 104 positionable along a first longitudinal edge of the mattress, a head portion 108 positionable along the head 30 of the mattress and a gap extension 106 of the inner portion 102 positionable toward the foot 40 of the mattress. The second panel 200 of the bed skirt of the invention similarly comprises an inner portion 202 positionable toward the center of a mattress, an outer portion 204 positionable along a second longitudinal edge of the mattress, a head portion 208 positionable along the head of the mattress and a gap extension 206 of the inner portion 202 positionable toward the foot 40 of the mattress. The third panel 300 of the bed skirt of the invention, situated between the first and second panels 100 and 200 respectively, comprises an inner portion 302 positionable toward the center of a mattress, an outer portion 304 positionable along a transverse edge or foot 40 of the mattress, and two gap extensions 306*a* and 306*b* of the inner portion 302 positionable in close proximity to the gap extensions 106 and 206 of the first and second panels 100 and 200 respectively. The gap extensions 106 and 306*a* are separated by a "V"-shaped notch or gap 60*a*, while the gap extensions 206 and 306*b* are separated by a similar gap 60*b*.

The "V"-shaped notches or gaps 60*a* and 60*b* as illustrated preferably do not extend all the way to the edge of the panels 100, 200 and 300, but terminate preferably just short of the edge, so there is some continuity between the panels. However, it should be understood that the notch could also be extended to the edge of the panels, in which case the dust ruffle itself will serve to connect the panels at their outer edges or portions. It will be found, however, that having the notch extend only part way, or most of the way, but not all of the way, to the edge provides better stability of the entire structure in use, since each panel in its mounted, or use, position is then held to the adjacent panel at two places, one at the end of the notch and the other in a more central position. As will be understood, a two position securing arrangement tends to be more stable than single point securing.

Each panel is preferably constructed from a cloth-like material that is resistant to slippage when positioned or tucked between two mattresses, and is approximately twelve inches wide, i.e. measured between the inner portion, 102 for example, and outer portion, 104 for example, of such panel, which is deemed sufficient to maintain each panel securely positioned between an upper and lower mattress. The panels will also be dimensioned in length to fit each of the different conventional mattress sizes, i.e. twin, extra long twin, full, queen, king and the like. Of course, a panel that is not wide enough will tend to become dislodged and therefore slip from its position between the mattresses, while a panel that is overly wide will require the user to forcefully separate the central regions between the two mattresses in order to place or tuck such panel therebetween, a feat that might be difficult and actually unnecessary for the proper securement of such panel. The panels should each preferably be no wider than half the width of the mattress they are placed upon, since if such panels were greater than half the width of the mattress, the extension of such panels across the mattress would create the appearance of a continuous sheet, which is currently found on bed skirts in the marketplace, and would also create an overlapping condition that should be avoided.

Gaps 60*a* and 60*b* are provided to allow manual manipulation, orientation and reorientation of the separate panels during attachment and removal of the bed skirt of the invention to and from a mattress. Removable fastening members 602 and 604 are utilized to fasten or secure adjacent panels 100 and 300 together after a desirable position of such panels on the mattress and with respect to each other has been achieved, while removable fastening members 606 and 608 are used to fasten or secure adjacent panels 300 and 200 together after a desirable position of such panels on the mattress and with respect to each other has been achieved. Thus, while the panels of the bed skirt of the invention are indeed joined along and in line with their outer portions 104, 304 and 204, gaps 60*a* and 60*b* between such panels enables such panels to be attached and oriented in an incremental fashion, i.e. one panel at a time. In other words, once panel 100 is initially tucked and positioned between an upper and lower mattress, such panel is fastened to panel 300 by fastening members 602 and 604, after which panel 300 is similarly tucked and positioned. The fastening together of panels 100 and 300 can also occur after both panels 100 and 300 have been properly positioned on the bed and with respect to each other. Similarly, after panel 100 has been tucked and positioned, and once panel 300 is initially tucked and positioned between an upper and lower mattress, such panel is fastened to panel 200 by fastening members 606 and 608, after which panel 200 is similarly tucked and positioned. The fastening together of panels 300 and 200 can also occur after both panels 300 and 200 have been properly positioned on the bed and with respect to each other. After all of the panels of the bed skirt of the invention have been properly positioned, adjustments can be easily and effortlessly made by merely adjusting the positions of the panels and the fastening members therebetween.

The removable fastening members are preferably of the hook and loop type, or Velcro® type, where, for example, fastening member 602 would be removably, but securely, positioned against fastening member 604 to secure the gap extension portions 106 and 306*a* together, and thus the panels 100 and 300. Similarly, fastening member 606 would be removably, but securely, positioned against fastening member 608 to secure the gap extension portions 306*b* and 206 together, and thus the panels 300 and 200. The fastening members could also comprise the ball and socket type, more commonly referred to as a snap, where, for example, one fastening member 602 could have a series of socket pieces positioned along such fastening member, while the other fastening member 604 could have a single ball piece or series of ball pieces positioned along such fastening member for adjustable fastening of both members 602 and 604 together. The fastening members could also comprise the button and loop type, where, for example, one fastening member 602 could have a series of buttons positioned along such fastening member, while the other fastening member 604 could have a single loop piece or series of loop pieces positioned along such fastening member for adjustable fastening of both members 602 and 604 together. The fastening members could also comprise the buckle and orifice type, where, for example, one fastening member 602 could have a series of orifices positioned along such fastening member, while the other fastening member 604 could comprise a strap having a buckle thereon for adjustable engagement of the tongue of the buckle with the orifices for adjustable fastening of both members 602 and 604 together. Other fastening methods may also be employed, such as, for example, a hook and ring system, or even a removable tape system currently used with diapers and the like.

While it is preferable to have two interengaging fastening members both attached to opposite panels, such as described and shown, the fastening system could also comprise three separate parts, wherein there is a fastener element on both panels and a separate, bridging fastening element that connects to and bridges the first two elements. For example, each of the panels may be provided with a hook-type pad of a Velcro® fastener and a loop-type fastening strap may be used to bridge the two. In such case, the loop-type fastening strap is preferably separately tied to one of the panels by a light line or string or the like to prevent loss when not being used for securing the two panels together.

FIG. 2 also illustrates a detachable fastener, designated generally as 500, comprising a central portion 505 and two end portions 510 and 510*a*, each end portion having a fastener receiving element 520 and 520*a* designed to accommodate fastening implements 530 and 530*a*, which implements are further designed for similar engagement with the receiving elements 420 and 420*a* positioned on the ruffle section 400. While the central portion 505 is preferably elastic for adjustable tightening, it will be understood that a non-elastic central portion will be satisfactory to secure the bed skirt along the head portion 30 or the like. The fastener 500 is provided to give the user the option to secure panels 100 and 200 together and to further secure the entire bed skirt arrangement in place (see FIG. 3). The receiving elements 420, 420*a*, 520 and 520*a*, are preferably of the grommet-type, while the fastening implements 530 and 530*a* are preferably of the "S"-hook variety. Of course, as noted above with respect to the various types of removable fasteners 602, 604, 606 and 608, the detachable fastener 500 can assume a variety of different embodiments. For example, while the implements 530 and 530*a* are shown as separate "S"-hook like pieces, they may actually be manufactured into the ends 510 and 510*a* of the elastic central member 505, and therefore assume a conventional "C"-hook like appearance, requiring the user to merely fasten such implements to the receiving elements 420 and 420*a*. The detachable fastener 500 could also be of the snap variety, where the receiving elements 420 and 420 could be of the socket-type, while the fastening implements 530 and 530*a* could be of the ball-type. The fastening implements 530 and 530*a* and receiving elements 420 and 420*a* could also be of the hook and loop or Velcro® type, button and orifice type, buckle and strap type, hook and ring type, or the like. In fact, the detachable fastener 500 could also be initially attached or anchored to the ruffle portion 400 at one of the receiving elements 420 or 420*a*, in which case the user would merely have to attach the non-attached end of the fastener 500 to the free receiving element. It is preferable, however, to have the detachable fastener 500 capable of complete detachment from the bed skirt should its implementation be undesired or unwarranted because no difficulty is being encountered in maintaining the panels between superimposed mattresses.

FIG. 3 is a perspective view of a lower mattress 50, shown from the head 30 of the mattress 50, and with the bed skirt of the invention positioned and fully secured thereon. Panels 100 and 300 are secured in place through the engagement of the removable fasteners 602 and 604, while panels 200 and 300 are similarly secured together through the engagement of the removable fasteners 606 and 608. FIG. 3 also illustrates the central elastic portion 505 of the detachable fastener extended between either end of the ruffle portion 400 adjacent the head portions 108 and 208 of panels 100 and 200 respectively, for further securement of the bed skirt of the invention about the mattress 50. While the removable fasteners 602, 604, 606 and 608 assist in maintaining the proper position of the bed skirt along the corners near the foot 40 of the mattress 50, the detachable fastener 500 assists in maintaining the proper position of the bed skirt along the head 30 of the mattress 50. Of course, the detachable fastener 500 is by no means necessary for the effective positioning and/or repositioning of the bed skirt of the invention on a mattress 50, and in fact, may be difficult to implement if the head portion 30 of the mattress 50 is inaccessible through the interference of a wall or headboard (not shown). Implementation of the detachable fastener 500 may also not be that critical because movement of a bed skirt in response to human activity on the bed usually occurs toward the foot portion 40 of a bed. However, if such movement does indeed occur toward the head portion 30 of the bed, and the detachable fastener 500 is in fact detached from the ruffle portion 400, then a user merely has to reposition that panel near the head portion 30 of the bed, which would most likely occur along the head portions 108 and/or 208 of the panels 100 and/or 200.

FIG. 4 is a top view of an alternative embodiment of the bed skirt of the invention with the detachable fastener 500 positioned between panels 100 and 200, and more specifically between sections 410*x* and 410*y* adjacent head portions 108 and 208 of such panels 100 and 200. The detachable fastener arrangement shown in FIG. 4 might be preferable over the arrangement shown, for example, in FIGS. 2 and 3, if the location of the detachable fastener is desired to be hidden between the upper and lower mattresses.

Figure 5:
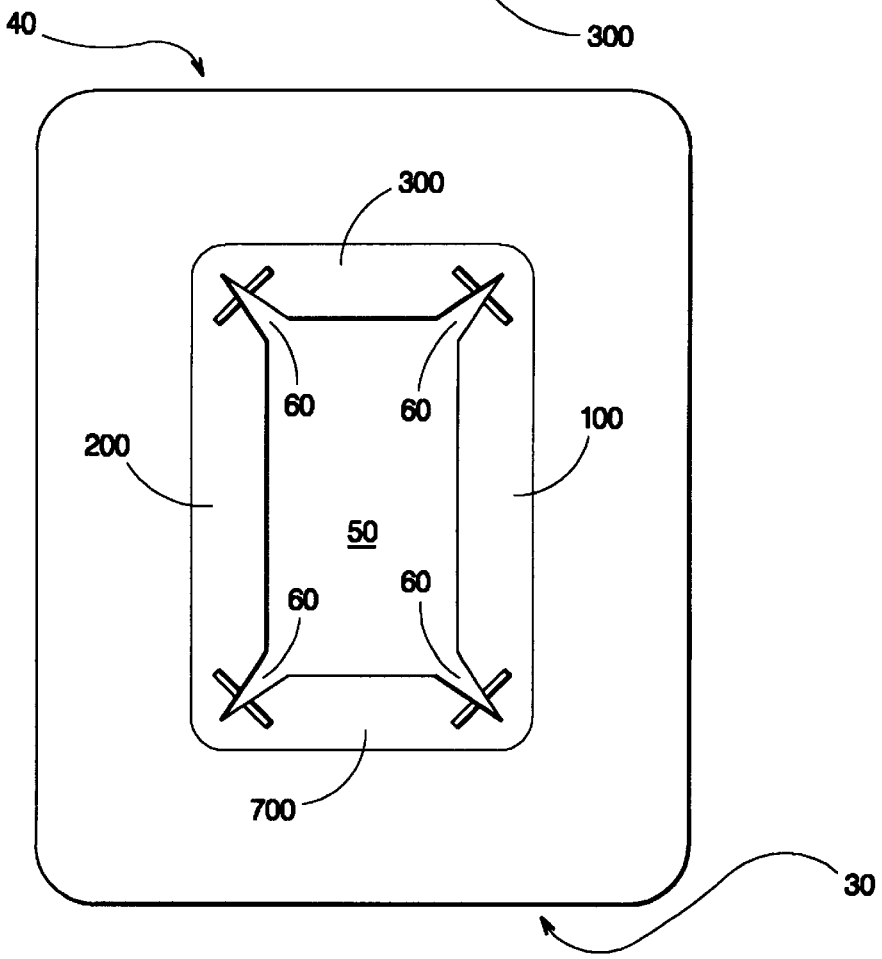
FIG. 5 is a top view of an alternative embodiment of the bed skirt of the invention showing a bed skirt extending around the entire perimeter of a bed.

FIG. 5 is a top view of an alternative embodiment of the bed skirt of the invention showing a panel arrangement extending about the entire perimeter of a bed. In additional to panels 100, 200 and 300 as described earlier, the bed skirt of FIG. 5 has a panel 700 adjacent the head portion 30 of the bed, with similar removable fastening means as previously described in connection with members 602, 604, 606 and 608. The bed skirt of FIG. 5 would be appropriate if all four sides of the bed were in plain view, or if the user wished a ruffle to extend about the entire perimeter of the bed. The bed skirt arrangement of FIG. 5 would not require a detachable fastener 500 since all four panels would be securely held in position by the removable fasteners. Of course, if the bed were positioned lengthwise against a wall or the like, then a bed skirt arrangement similar to that of FIG. 6 might be appropriate, having head and foot panels 700 and 300 and one side panel 100, with, of course, appropriate removable fastening members as shown. Similarly, if the bed were positioned against two walls of a room, i.e. a corner, or the like, then a bed skirt arrangement similar to that of FIG. 7 might be appropriate, having one foot panel 300 and one side panel 100, with, of course, appropriate removable fastening members as shown.

While it is preferable to have a single piece ruffle extending along the bed on all visible sides of the bed, it should be understood that such single piece or unitary ruffle, could actually be composed of separate, preferably overlapping sections generally tied together by the supporting panels from which they depend. Such an arrangement may still be considered and is referred to as a single piece ruffle or bed ruffle.

While the present invention has been described at some length and with some particularity with respect to the several described embodiments, it is not intended that it should be limited to any such particulars or embodiments or any particular embodiment, and is to be construed with references to the appended claims so as to provide the broadest possible interpretation of such claims in view of the prior art and, therefore, to effectively encompass the intended scope of the invention.

I claim:

1. A bed skirt for positioning on a bed between an upper mattress and a lower mattress comprising:

a. a plurality of panels positionable along the upper surface of a lower mattress, each panel having an inner portion positionable toward the center of the mattress and an outer portion positionable along the edge of the mattress, b. said panels being effectively joined together along their outer portions, but separated by a gap along their inner portions, c. removable fastening means available for fastening together the separation of the panels over the gap along their inner portions, and d. a single-piece bed ruffle depending from and secured to said outer portions of said panels.

2. A bed skirt in accordance with claim 1 wherein the panels are effectively joined together along their outer portions by a continuous strip of panel material along their outer portions as the result of the gap along the inner portion extending only part way between the panels.

3. A bed skirt in accordance with claim 2 wherein the width of each of said panels are each no greater than half the width of said lower mattress.

4. A bed skirt in accordance with claim 3 wherein said panels extend are positioned about at least three sides of the bed.

5. A bed skirt in accordance with claim 4 further comprising a detachable fastener securable to the bed skirt between a pair of oppositely, similarly situated panels.

6. A bed skirt in accordance with claim 5 wherein said detachable fastener is elastically securable.

7. A bed skirt in accordance with claim 4 wherein the removable fastening means comprises hook and loop type fasteners.

8. A bed skirt in accordance with claim 4 wherein the removable fastening means comprises snap-type fasteners.

9. A bed skirt in accordance with claim 4 wherein the removable fastening means comprises buckle and strap-type fasteners.

10. A bed skirt in accordance with claim 2 wherein said panels extend about the perimeter of the bed.

* * * * *